US010165345B2

(12) United States Patent
Slater et al.

(10) Patent No.: US 10,165,345 B2
(45) Date of Patent: Dec. 25, 2018

(54) HEADPHONES WITH COMBINED EAR-CUP AND EAR-BUD

(71) Applicant: NURA HOLDINGS PTY LTD, Brunswick, Victoria (AU)

(72) Inventors: Kyle Damon Slater, Brunswick (AU); Luke John Campbell, Brunswick (AU); Dragan Petrovic, Union City, CA (US)

(73) Assignee: NURA HOLDINGS PTY LTD, Brunswick, Victoria (AU)

( * ) Notice: Subject to any disclaimer, the term of this patent is extended or adjusted under 35 U.S.C. 154(b) by 0 days.

(21) Appl. No.: 15/398,282

(22) Filed: Jan. 4, 2017

(65) Prior Publication Data

US 2017/0208380 A1 Jul. 20, 2017

(30) Foreign Application Priority Data

Jan. 14, 2016 (AU) ..... 2016900104
Apr. 16, 2016 (AU) ..... 2016901426

(51) Int. Cl.
*H04R 1/10* (2006.01)

(52) U.S. Cl.
CPC ..... *H04R 1/1008* (2013.01); *H04R 1/1016* (2013.01); *H04R 1/1083* (2013.01); *H04R 2460/01* (2013.01); *H04R 2460/13* (2013.01)

(58) Field of Classification Search
CPC ..... A42B 1/06; A42B 3/16; A61F 2011/145; A61F 11/12; A61F 11/14; A61F 11/06;
(Continued)

(56) References Cited

U.S. PATENT DOCUMENTS 4,138,743 A 2/1979 Elkins et al.
6,118,878 A * 9/2000 Jones ..... G10K 11/178 381/72

(Continued)

FOREIGN PATENT DOCUMENTS

KR 101142727 B1 5/2012
WO 2010021414 A1 2/2010

(Continued)

OTHER PUBLICATIONS

International Search Report and Written Opinion dated Jun. 9, 2017, for International Application No. PCT/IB2017/000065, 13 pages.

(Continued)

*Primary Examiner* — Fan Tsang
*Assistant Examiner* — Angelica M McKinney
(74) *Attorney, Agent, or Firm* — Perkins Coie LLP

(57) ABSTRACT

Presented here is an apparatus and method to increase a listener's enjoyment of sound by combining in-ear headphones with either over-ear headphones or on-ear headphones. One embodiment is headphones that include an ear-cup with an ear-bud protruding toward the listener's ear-canal. The ear-cup substantially surrounds the listener's ear and delivers sub sonic and low-frequency vibrations to the listener's skin stimulating a vibrotactile response. The ear-bud is disposed within the listener's ear canal and delivers a full range of audible frequencies. Additionally, the headphones, along with the ear-cup in the ear-bud, provide both passive and active noise cancellation.

30 Claims, 10 Drawing Sheets

(58) Field of Classification Search
CPC .. G10K 11/175; H04R 1/1008; H04R 1/1016; H04R 1/1083; H04R 2460/13
See application file for complete search history.

(56) References Cited

U.S. PATENT DOCUMENTS

| | | | | |
|---|---|---|---|---|
| 8,189,846 | B2 | 5/2012 | Tiscareno et al. | |
| 9,942,647 | B2 | 4/2018 | Di Censo et al. | |
| 2002/0027996 | A1* | 3/2002 | Leedom | H04R 25/608 381/322 |
| 2010/0166203 | A1* | 7/2010 | Peissig | G10K 11/178 381/71.6 |
| 2010/0189277 | A1* | 7/2010 | Birgersson | A61F 11/12 381/73.1 |
| 2010/0220885 | A1 | 9/2010 | Singh | |
| 2011/0268290 | A1 | 11/2011 | Lee | |
| 2014/0079274 | A1 | 3/2014 | Monahan et al. | |
| 2015/0030173 | A1 | 1/2015 | Foudhaili et al. | |
| 2015/0193196 | A1* | 7/2015 | Lin | G06F 3/165 715/716 |
| 2017/0325738 | A1 | 11/2017 | Antos et al. | |
| 2018/0014973 | A1 | 1/2018 | Echeverri et al. | |

FOREIGN PATENT DOCUMENTS

| | | | |
|---|---|---|---|
| WO | 2015076644 | A1 | 5/2015 |
| WO | 2016148316 | A1 | 9/2016 |

OTHER PUBLICATIONS

Non-Final Office Action dated Jun. 29, 2018 of U.S. Appl. No. 15/585,524 by Slater, K. D., et al., filed May 3, 2017.
U.S. Appl. No. 15/585,524 by Slater, K. D., et al., filed May 3, 2017.
International Search Report and Written Opinion dated Apr. 26, 2018 of PCT/US18/17692 (9 pages).

* cited by examiner

HEADPHONES WITH COMBINED EAR-CUP AND EAR-BUD

CROSS-REFERENCE TO RELATED APPLICATIONS

This application claims priority to the Australian provisional patent application Serial Number 2016901426, filed Apr. 16, 2016, and the Australian provisional patent application Serial Number 2016900104, filed Jan. 14, 2016, which are incorporated herein by reference in their entirety.

TECHNICAL FIELD

The present application relates generally to headphones for listening to music, voice or other sound, and in particular to combining an in-ear section that delivers sound directly to the ear canal and an over-ear or on-ear section that delivers additional audio vibrotactile stimulation.

BACKGROUND

Ear-buds or in-ear monitors can generate the sound waves required in the ear canal to create an auditory percept equivalent to sound experienced from free field loud speakers or from live music or speech. Auditory percepts, however, are only one aspect of the human experience of sound. The cutaneous sensory system is also capable of detecting low frequency sounds via the mechanical vibration of cutaneous sensory receptors. This is known as vibrotactile stimulation.

The skin has two different kinds of touch and two kinds of vibration receptors, also known as mechanoreceptors, relevant to the perception of vibrotactile stimulation: Meissner's corpuscles and Pacinian corpuscles. The Meissner's corpuscles have a resonant frequency around 20 Hz and the Pacinian corpuscles have a resonance frequency around 200 Hz. Consequently, the cutaneous sensory system is most sensitive to low audio frequencies and sub sonic vibrations.

SUMMARY

For the listener to experience sound played by ear-buds or in-ear monitors in a similar way the listener experiences sound played live or by free field speakers, both vibrotactile stimulation and acoustic stimulation are important. Furthermore, the experience of sound and music in general can be enhanced by adding vibrotactile stimulation.

Presented here is an apparatus and method to increase a listener's enjoyment sound by combining in-ear headphones with either over-ear headphones or on-ear headphones. In one embodiment, the headphones include an ear-cup with an ear-bud protruding toward the listener's ear-canal. The ear-cup substantially covers or surrounds the listener's ear and delivers low-frequency vibrations to the listener's skin exciting fast acting mechanoreceptors. The ear-bud is disposed within the listener's ear canal and delivers the full audible range of frequencies. Additionally, the headphones, along with the ear-cup and the ear-bud, provide passive noise isolation and can optionally include active noise cancellation.

BRIEF DESCRIPTION OF THE DRAWINGS

These and other objects, features and characteristics of the present embodiments will become more apparent to those skilled in the art from a study of the following detailed description in conjunction with the appended claims and drawings, all of which form a part of this specification. While the accompanying drawings include illustrations of various embodiments, the drawings are not intended to limit the claimed subject matter.

DETAILED DESCRIPTION

Terminology

Figure 1:
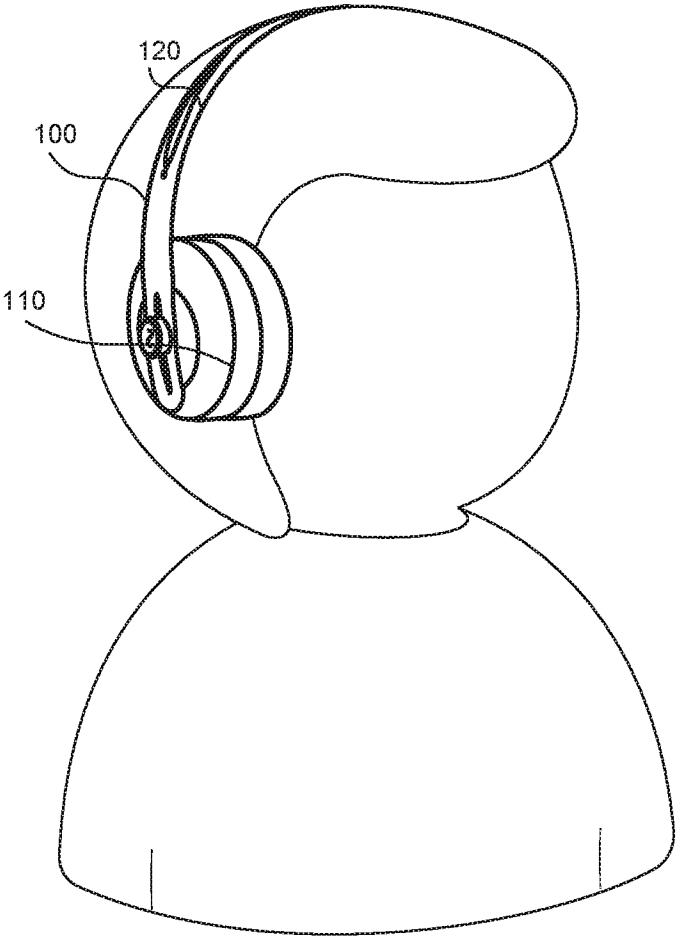
FIG. 1 shows headphones placed proximate to a listener's head, according to one embodiment.

Brief definitions of terms, abbreviations, and phrases used throughout this application are given below.

Reference this specification to "sub sonic vibrations" means vibrations below 20 Hz. Reference in the specification to "low-frequency audio" means vibrations substantially within 20 Hz to 250 Hz range. Reference in this specification to "mid-frequency audio" means vibrations substantially within 250 Hz to 4000 Hz range. Reference in this specification to "high-frequency audio" means vibrations substantially within 4000 Hz to 22,000 Hz range.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described that may be exhibited by some embodiments and not by others. Similarly, various requirements are described that may be requirements for some embodiments but not others.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements. The coupling or connection between the elements can be physical, logical, or a combination thereof. For example, two devices may be coupled directly or via one or more intermediary channels or devices. As another example, devices may be coupled in such a way that information can be passed there between, while not sharing any physical connection with one another. Additionally, the words "herein," "above," "below," and words of similar import when used in this application shall refer to this application as a whole and not to any particular portions of this application. Where the context permits, words in the Detailed Description using the singular or plural number may also include the plural or singular number respectively. The word "or" in reference to a list of two or more items covers all of the following interpretations of the word: any of the items in the list, all of the items in the list, and any combination of the items in the list.

If the specification states a component or feature "may," "can," "could," or "might" be included or have a characteristic, that particular component or feature is not required to be included or have the characteristic.

The term "module" refers broadly to software, hardware or firmware components (or any combination thereof). Modules are typically functional components that can generate useful data or another output using specified input(s). A module may or may not be self-contained. An application program (also called an "application") may include one or more modules, or a module may include one or more application programs.

The terminology used in the Detailed Description is intended to be interpreted in its broadest reasonable manner, even though it is being used in conjunction with certain examples. The terms used in this specification generally have their ordinary meanings in the art, within the context of the disclosure, and in the specific context where each term is used. For convenience, certain terms may be highlighted, for example using capitalization, italics, and/or quotation marks. The use of highlighting has no influence on the scope and meaning of a term; the scope and meaning of a term is the same in the same context whether or not it is highlighted. It will be appreciated that the same element can be described in more than one way.

Consequently, alternative language and synonyms may be used for any one or more of the terms discussed herein, but special significance is not to be placed upon whether or not a term is elaborated or discussed herein. A recital of one or more synonyms does not exclude the use of other synonyms. The use of examples anywhere in this specification, including examples of any terms discussed herein, is illustrative only and is not intended to further limit the scope and meaning of the disclosure or of any exemplified term. Likewise, the disclosure is not limited to various embodiments given in this specification.

Headphones

FIG. 1 shows headphones placed proximate to a listener's head, according to one embodiment. Headphones 100 include an ear-cup 110 placed over a listener's ear, a headband 120, and an ear-bud (not pictured) placed within or at the entrance of a listener's ear canal. The headphones 100 include various acoustic chambers to deliver audio frequencies and subsonic frequencies to the listener. The headphones 100 have more touch-points to the listener then classical headphones: the headband 120, the ear-cup 110, as well as the ear-bud. Due to the many touch points to the listener, the headphones 100 provide a solid, comfortable fit.

Figure 2:
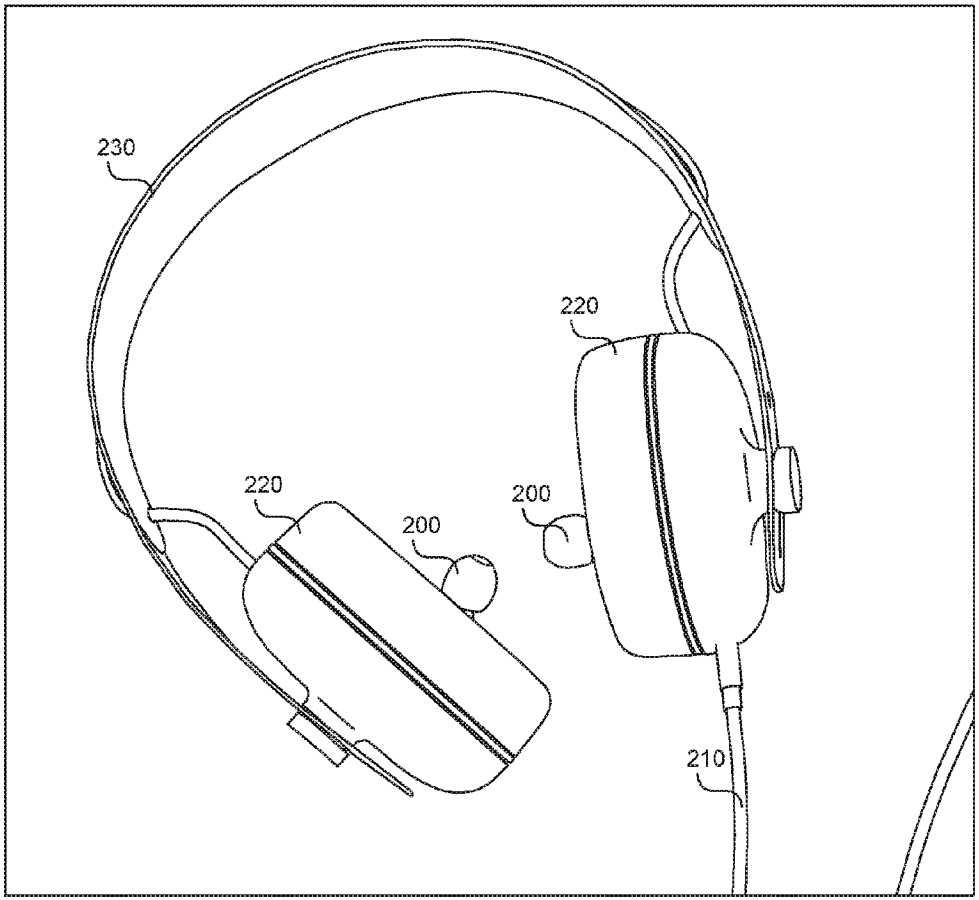
FIG. 2 shows front view of the headphones 100, according to one embodiment.

FIG. 2 shows front view of the headphones 230, according to one embodiment. Ear-buds 200 are disposed within each ear-cup 220. The headphones 230 can be connected to an audio source via a wired connection 210, a wireless connection, a data network, a wireless network, a telephony network, a broadcast signal, or any combination thereof. The data network may be any local area network (LAN), metropolitan area network (MAN), wide area network (WAN), a public data network (e.g., the Internet), short range wireless network, or any suitable packet-switched network, such as a commercially owned, proprietary packet-switched network (e.g., a proprietary cable or fiber-optic network, and the like, or any combination thereof). In addition, the wireless network may be, for example, a cellular network and may employ various technologies including enhanced data rates for global evolution (EDGE), general packet radio service (GPRS), global system for mobile communications (GSM), Internet protocol multimedia subsystem (IMS), universal mobile telecommunications system (UMTS), etc., as well as any other suitable wireless medium, e.g., worldwide interoperability for microwave access (WiMAX), Long Term Evolution (LTE) networks, code division multiple access (CDMA), wideband code division multiple access (WCDMA), wireless fidelity (WiFi), wireless LAN (WLAN), Bluetooth®, Internet Protocol (IP) data casting, satellite, mobile ad-hoc network (MANET), and the like, or any combination thereof.

The wired connection may be analog or digital or any combination thereof. The broadcast signal may be Frequency Modulated (FM) radio, Amplitude Modulated (AM) radio, or any combined audio-video transmission standard such as National Television System Committee (NTSC), Advanced Television System Committee (ATSC), Integrated Services Digital Broadcasting (ISDB), Phase Alternating Line (PAL), Sequential Color with Memory (SECAM), Digital Video Broadcasting (DVB), Digital Terrestrial Multimedia Broadcast (DTMB) or any combination thereof.

Figure 3:
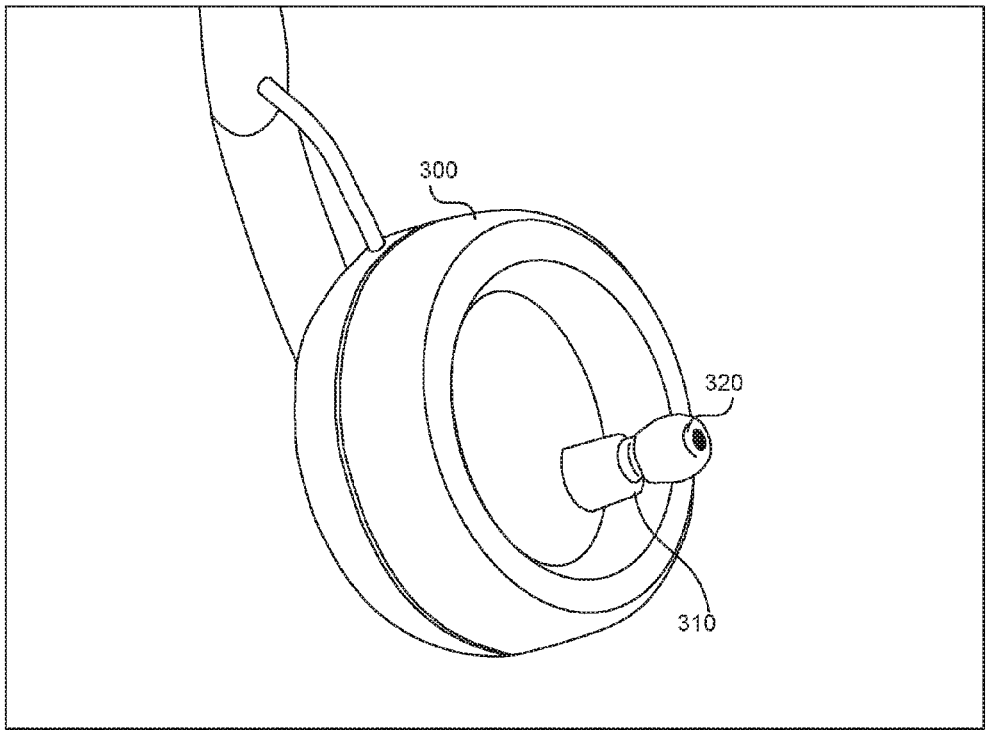
FIG. 3 shows a three quarters view of one of the ear-cups, according to one embodiment.

FIG. 3 shows a three quarters view of one of the ear-cups according to one embodiment. An ear-cup 300 includes an ear-bud 310. To increase the listener's comfort, the ear-bud can be attached to the ear-cup by an elastic attachment such as a spring or flexible scaffolding. The elastic attachment provides sufficient degrees of freedom to enable a universal fit by passively conforming to the listener's ear shape. The ear-bud 310 includes a soft ear-bud tip 320 to further increase the listener's comfort. The soft ear-bud tip 320 can be made of a soft material filled with fluid such as air, water or a viscous fluid. The soft material allows the tip to comfortably shape itself to the listener's ear and entrance to a listener's ear canal. Unlike conventional ear-buds and in-ear monitors (IEMs), the force required to prevent the in-ear section from falling out does not need to be developed by friction on the skin of the listener's ear canal or from a touch point in the ear. Instead, a gentle force applied to the ear-bud 310 from the ear-cup 300 keeps the ear-bud 310 inside the listener's ear canal or at the entrance of the listener's ear canal, and thus improves the listener's comfort by eliminating friction inside the listener's ear canal. The ear-bud 310 delivers clear sound directly to the listener's ear canal.

Figure 4:
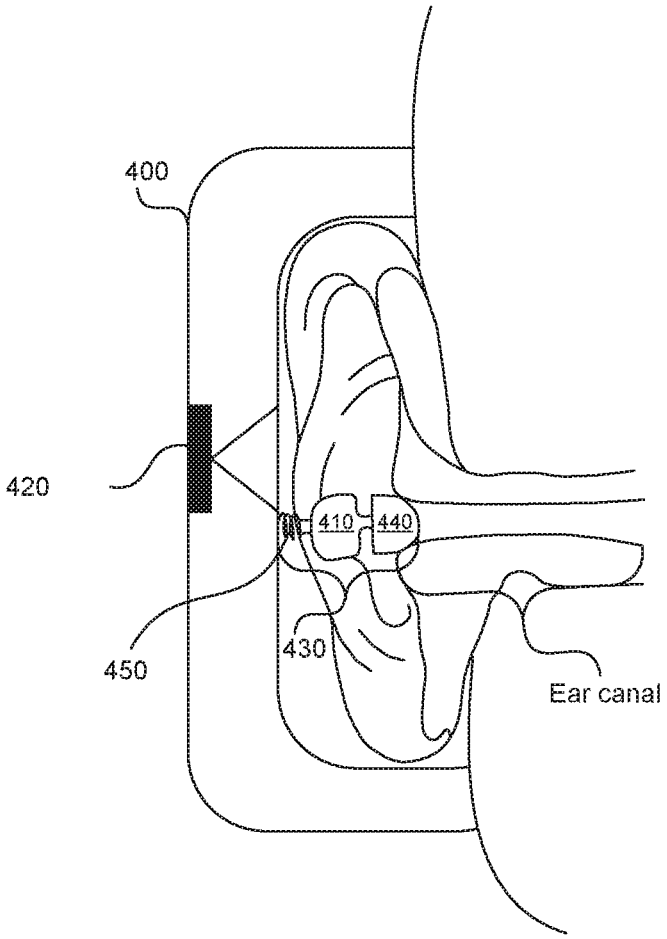
FIG. 4 shows an ear-cup associated with headphones, the ear-cup placed proximate to a listener's ear, according to one embodiment.

FIG. 4 shows an ear-cup associated with headphones, the ear-cup placed proximate to a listener's ear, according to one embodiment. The ear-cup 400 includes a vibrotactile speaker 420, and an ear-bud 430.

The ear-bud 430, disposed within or at the entrance of a listener's ear canal, includes an auditory speaker 410 and a soft ear-bud tip 440 that occludes the listener's ear canal from external audio, such as audio outside the ear-cup and audio outside the ear-bud. The auditory speaker 410 can be a balanced armature driver or a dynamic driver.

The ear-cup 400 is disposed to prevent a substantial portion of ambient sound from reaching the listener's ear.

The ear-cup 400 can completely surround the listener's ear by pressing against the listener's skull (circumaural), can partially press against the listener's skull and the listener's ear, or can solely press against the listener's ear (supraural).

The vibrotactile speaker 420 can be a dynamic loud speaker. The vibrotactile speaker 420 can deliver sub sonic vibrations and/or low-frequency audio to the listener's skull and/or the listener's ear. Because the listener's ear canal is occluded by the ear-bud 430, the vibrotactile speaker 420 can be driven to a louder sound pressure level than an equivalent standard headphone. Consequently, the louder sound pressure provides enhanced vibrotactile stimulation. Spring 450 provides elastic attachment of the ear-bud 430 to the ear-cup 400, thus increasing the listener's comfort, as discussed herein. The vibrotactile speaker 420 can also be used to provide Active Noise Cancellation cancelling out ambient noise.

The ear-cup 400 and the ear-bud 430 provide additional methods for passive acoustic isolation. The soft ear-bud tip 440 placed within or at the entrance of the listener's ear canal, and the ear-cup 400, provide a double layer of isolation greatly reducing the amount of outside noise that can be heard by the listener while wearing the headphones. Additionally, the double layer of isolation greatly reduces the amount of the sound that leaks out of the headphones into the outside environment. The double layer of isolation provides excellent acoustic isolation for others, allowing the listener to enjoy sound without disturbing those around the listener.

Further, the double layer of acoustic isolation improves characterization of the listener's hearing profile. The acoustic isolation allows for a reduction in the amount of outside noise that enters the ear canal. Consequently, the acoustic isolation allows for faster and more accurate measurement of the listener's hearing profile as described in U.S. patent application Ser. No. 15/154,694, filed May 13, 2016, entitled PERSONALIZATION OF AUDITORY STIMULUS, and incorporated herein by reference.

Figure 5:
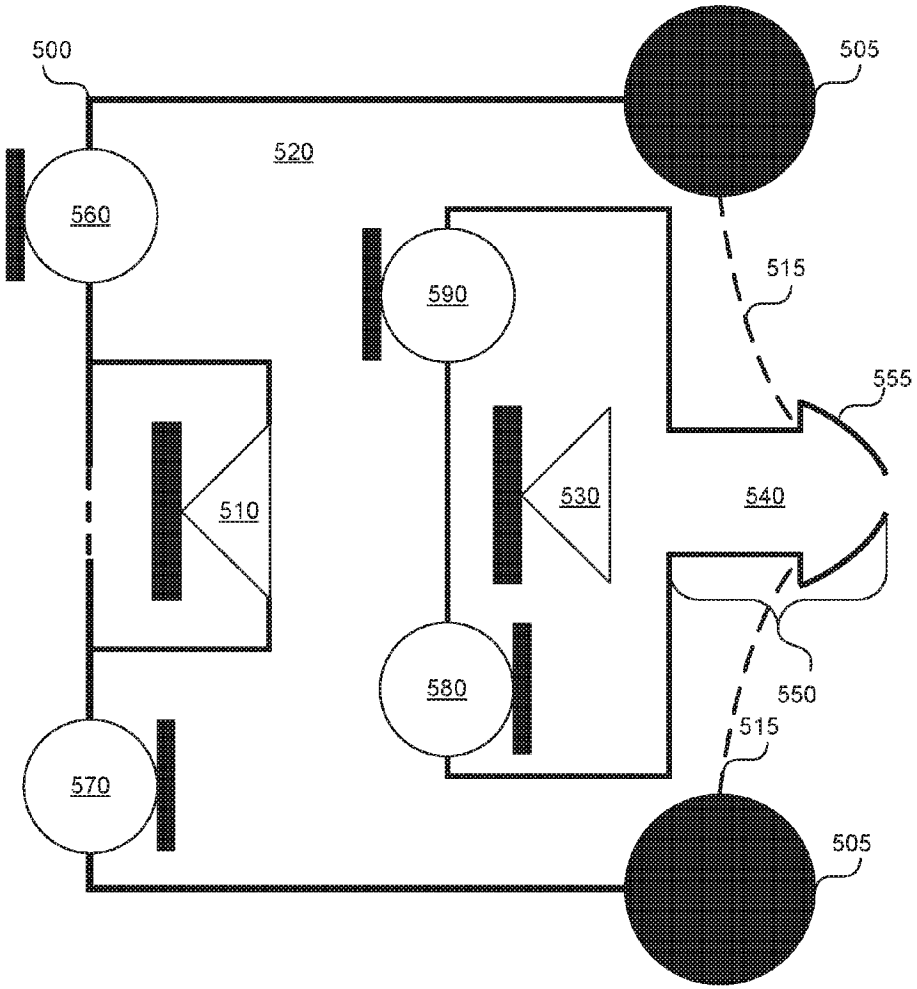
FIG. 5 is a cross-section of an ear-cup associated with headphones, according to one embodiment.

FIG. 5 is a cross-section of an ear-cup associated with headphones, according to one embodiment. The ear-cup 500 includes a first speaker 510, a first acoustic chamber 520, a second speaker 530, a second acoustic chamber 540, an ear-bud 550, an ear-bud tip 555, a plurality of microphones 560, 570, 580, 590, an ear-pad 505, and optional acoustically transparent scaffolding 515.

The first speaker 510 emits a first range of frequencies. The first speaker 510 can be a contact mode speaker, a loud low-frequency acoustic speaker, a speaker, a low-frequency speaker such as a woofer, and/or a device to electrically stimulate cutaneous receptors. The first range of frequencies emitted by the first speaker 510 can include a broad range of audio frequencies, usually emphasizing sub sonic vibrations, low-frequency audio, and/or mid-frequency audio. The first range of frequencies can be generated by performing a low-pass filter on the input audio.

The first acoustic chamber 520 delivers the first range of frequencies to a listener using vibrotactile stimulation of the listener's skin. The first acoustic chamber 520 can be disposed within the ear-cup 500, but outside the ear-bud 550. The first acoustic chamber 520 is disposed proximate to the listener's skin. The first acoustic chamber 520 can also be disposed within a headband associated with the headphones. The first acoustic chamber 520 delivers the first range of frequencies to the listener through the optional acoustically transparent scaffolding 515 and/or ear-pad 505. The appearance of the scaffolding indicates to the user that the ear-bud 550 does not penetrate into the ear canal.

The second speaker 530 emits a second range of frequencies. The second range of frequencies can include the full range of audible frequencies in an input audio or a subset of audible frequencies such as frequencies substantially complementing the first range of frequencies. The second speaker 530 can be a speaker, and/or a high frequency speaker such as a tweeter. The first speaker 510 and the second speaker 530 can receive the first range of frequencies, and the second range of frequencies from a crossover circuit, as described in FIG. 7. Alternatively, the first speaker 510 and the second speaker 530 can receive a full range of frequencies, and be passively tuned to emit only the first range of frequencies and the second range of frequencies, respectively.

The second acoustic chamber 540 delivers the second range of frequencies to the listener through acoustic stimulation of a listener's ear. The second acoustic chamber 540 is disposed within an ear-bud associated with the headphones.

The ear-bud 550 surrounds the second acoustic chamber 540. The ear-bud 550 is disposed at the entrance to or within the listener's ear canal. The ear-bud 550 prevents the substantial portion of the ambient sound and a substantial portion of the first range of frequencies from reaching the listener's ear canal.

The ear-cup 500, in addition to the passive noise cancellation, can perform active noise cancellation (ANC) using one or more microphones 560, 570, 580, 590, the first speaker 510 and/or the second speaker 530, and one or more noise cancellation circuits (not pictured). The ear-cup 500 includes the one or more microphones 560, 570, 580, 590. The one or more microphones 560, 570, 580, 590 measure a plurality of undesired audio signals. The undesired audio signals are processed using either feedforward or feedback mechanism, or combination of both, depending on the position of the microphones used an the number of microphones used.

ANC can be done using any combination of at least one microphone 560, 570, 580 and 590 and at least one speaker 510, 530. One possible implementation is using microphone 560 to measure the undesired audio signals outside the ear-cup 500, using the first speaker 510 to cancel out the undesired audio signal entering the first acoustic chamber 520 and using microphone 570 and/or 590 to check how well the undesired audio signal was cancelled out and adjusting the cancellation accordingly. Another possible implementation is using microphone 560 to measure the undesired audio signals outside the ear-cup 500, using the first speaker 510 to cancel out the undesired audio signal entering the first acoustic chamber 520, using microphone 570 and/or 590 to measure the undesired audio signal in 520, using 530 to cancel out the undesired audio signal measured by 570 and/or 590, using microphone 580 to check how well the undesired audio signal was cancelled out and adjusting the cancellation accordingly.

One or more noise cancellation circuits together with the plurality of microphones 560, 570, 580, 590 and plurality of speakers 510, 530 are used in active noise cancellation. The one or more noise cancellation circuits can be digital and/or analog. A digital noise cancellation circuit can include a processor to perform the ANC. For each undesired audio signal in the plurality of undesired audio signals, the one or more noise cancellation circuits generate a canceling signal such that the canceling signal destructively interferes with the undesired audio. The canceling signal can include a phase shift of the undesired audio or inverted polarity of the undesired audio, thus destructively interfering with the undesired audio signal. For each undesired audio signal in the plurality of undesired audio signals, the one or more noise cancellation circuits deliver the canceling signal to the first speaker 510 and/or the second speaker 530. A noise cancellation circuit can be associated with each of the plurality of microphones 560, 570, 580, 590, or a single noise cancellation circuit can be associated with two or more of the microphones in the plurality of microphones 560, 570, 580, 590.

The technology described herein minimizes the undesired effects of active noise cancellation including high-frequency noise and increased pressure on a listener's eardrum. The ear-bud 550 surrounding the second acoustic chamber 540 includes an ear-bud tip 555 to isolate the listener's ear canal from undesired effects of active noise cancellation produced by the first speaker 510. The isolation provided by the ear-bud tip 555 allows for two stages of ANC: first, from the outside of the headphones to the first acoustic chamber 520; and second, from the first acoustic chamber 520 to the second acoustic chamber 540. The second stage of ANC is performed using a microphone on the outside of the second acoustic chamber 540, such as microphone 590, the second speaker 530, and microphone 580.

The isolation of the listener's ear-canal provided by the ear-bud tip 555 ensures that the stimulation of the first speaker 510 affects minimally or not at all the stimulation delivered through the ear-bud 550. In some cases signal processing could be used to combine or cancel out the effects of the ear-cup acoustic stimulation on the ear-bud acoustic stimulation.

The ear-bud tip 555 placed within or at the entrance of the listener's ear canal, and the ear-cup 500, provide a double layer of isolation greatly reducing the amount of outside noise, i.e. ambient sound, that can be heard by the listener while wearing the headphones. The double layer of isolation enables the microphone 580 placed within the ear-bud 550 to detect the listener's voice without interference from the ambient sound, and to enable voice communication. For example, the listener's voice detected by the microphone 580 can be interpreted into commands to control the headphones, such as "stop playing the music," "start playing the music," "find my favorite song," etc. Additionally, the headphones can send the listener's voice detected by the microphone 580 to a remote processor for storage, and/or transmission to another user. In one embodiment, the headphones can act as a cell phone headset.

Figure 6:
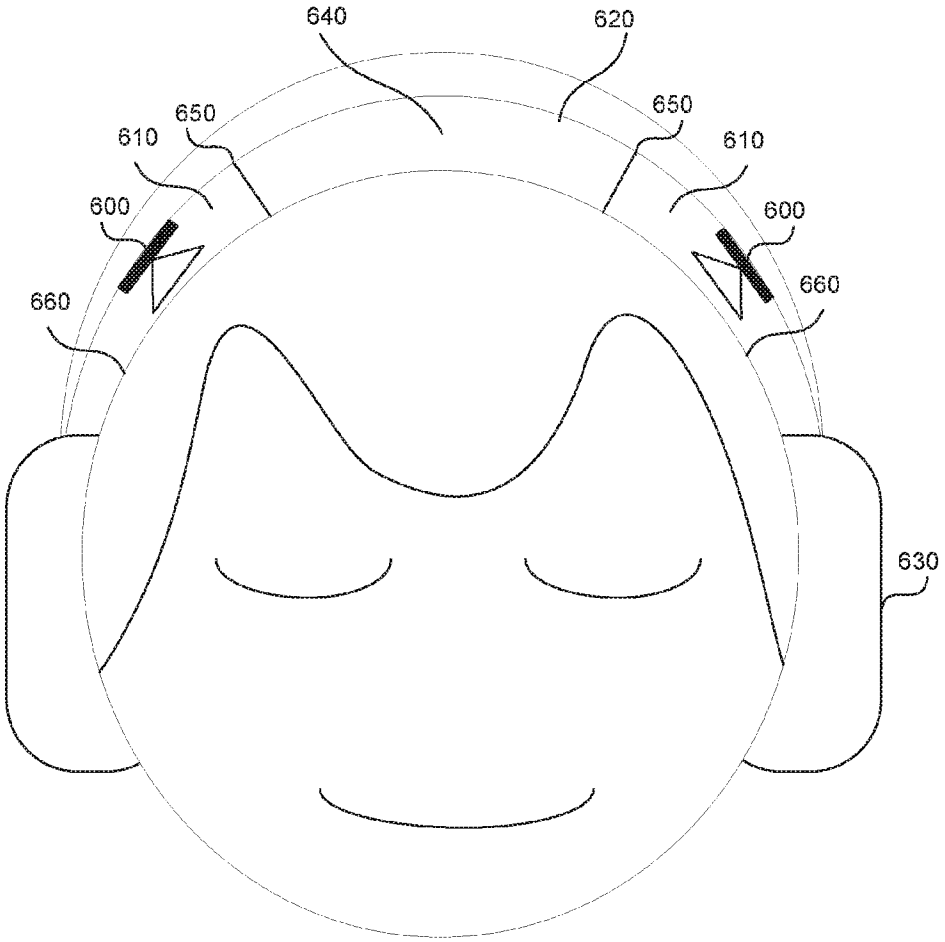
FIG. 6 shows a location of a speaker and an acoustic chamber, according to one embodiment.

FIG. 6 shows a location of a speaker and an acoustic chamber, according to one embodiment. Headphones 630 include a speaker 600, and acoustic chamber 610, headband 620, an optional chamber 640, a separator 650, and an optional acoustically transparent scaffolding 660. The speaker 600 and the acoustic chamber 610 can be disposed within the headband 620 associated with the headphones 630. The speaker 600 and the acoustic chamber 610 can be the first speaker 510, and the first acoustic chamber 520 in FIG. 5. Alternatively, the speaker 600, and the acoustic chamber 610 can exist in addition to the first speaker 510 and the first acoustic chamber 520 in FIG. 5. The speaker 600 can emit a first range of frequencies including sub sonic vibrations, low-audio frequencies, mid-frequencies, and or high-frequencies. The speaker 600 can be a single speaker, and the acoustic chamber 610 can be a single acoustic chamber encompassing the interior of the headband 620. Alternatively, as shown in FIG. 6, there can be two or more speakers 600, and/or two or more acoustic chambers 610. The left and right acoustic chamber 610 can be separated by the optional chamber 640 associated with a headband 620. Alternatively, the left and right acoustic chamber 610 can be separated by a separator 650 made out of acoustically opaque material. The acoustically transparent scaffolding 660 disposed on the outer surface of the headband 620 allows the first range of frequencies to pass and reach the listener.

Figure 7:
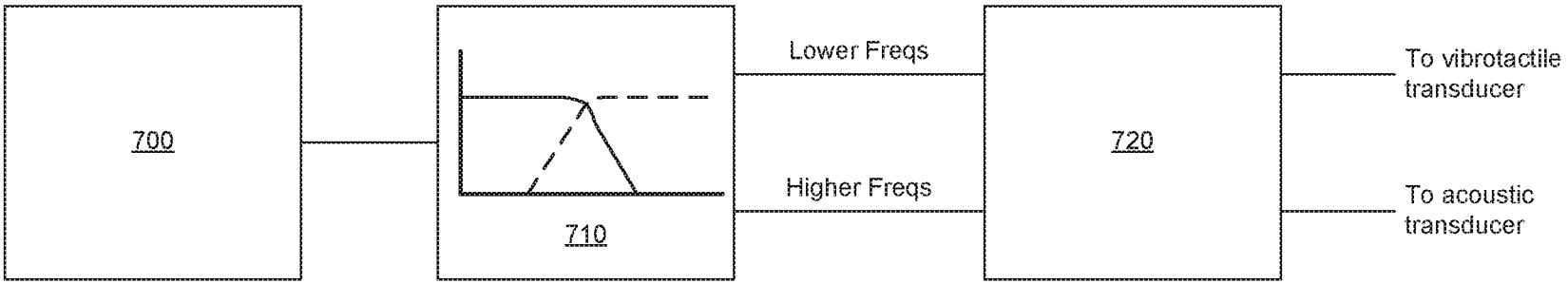
FIG. 7 shows internal electronics modules associated with headphones, according to one embodiment.

FIG. 7 shows internal electronics modules associated with headphones, according to one embodiment. The internal electronics modules includes an audio source 700, a crossover circuit 710, and an optional power amplifier 720. The audio source 700 is coupled to the crossover circuit 710 and the optional power amplifier 720. The audio source 700 sends an audio signal to the crossover circuit 710. The crossover circuit 710 separates lower-frequency audio and/or sub sonic vibrations from higher-frequency audio. The crossover circuit 710 sends the lower-frequency audio to the optional power amplifier 720. Separately, the crossover circuit 710 sends the higher-frequency audio to the optional power amplifier 720. The crossover circuit 710 can be a digital circuit including a processor, or can be an analog circuit. The lower-frequency audio is sent to a vibrotactile speaker while the higher-frequency audio is sent to an acoustic speaker. The lower-frequency audio and higher-frequency audio can, but do not necessarily correspond to the low-frequency and high-frequency audio ranges, respectively.

Alternative embodiments that cause less acoustic stimulation or that are placed further from the ear may not necessarily require the crossover circuit 710. Likewise alternative embodiments may not require the optional power amplifier 720.

In another embodiment, the crossover circuit 710 is not needed, and both of the acoustic speaker and the vibrotactile speaker receive the full range of frequencies. The acoustic speaker and the vibrotactile speaker can play the received full range of frequencies. Alternatively, the acoustic speaker and the vibrotactile speaker can be tuned to emit only a certain range of frequencies. For example, the vibrotactile speaker can be tuned to emit low-frequency audio and/or subsonic vibrations, while the acoustic speaker can be tuned to emit high-frequency audio. Mid-frequency audio can be emitted either by the first or the second speaker.

Figure 8:
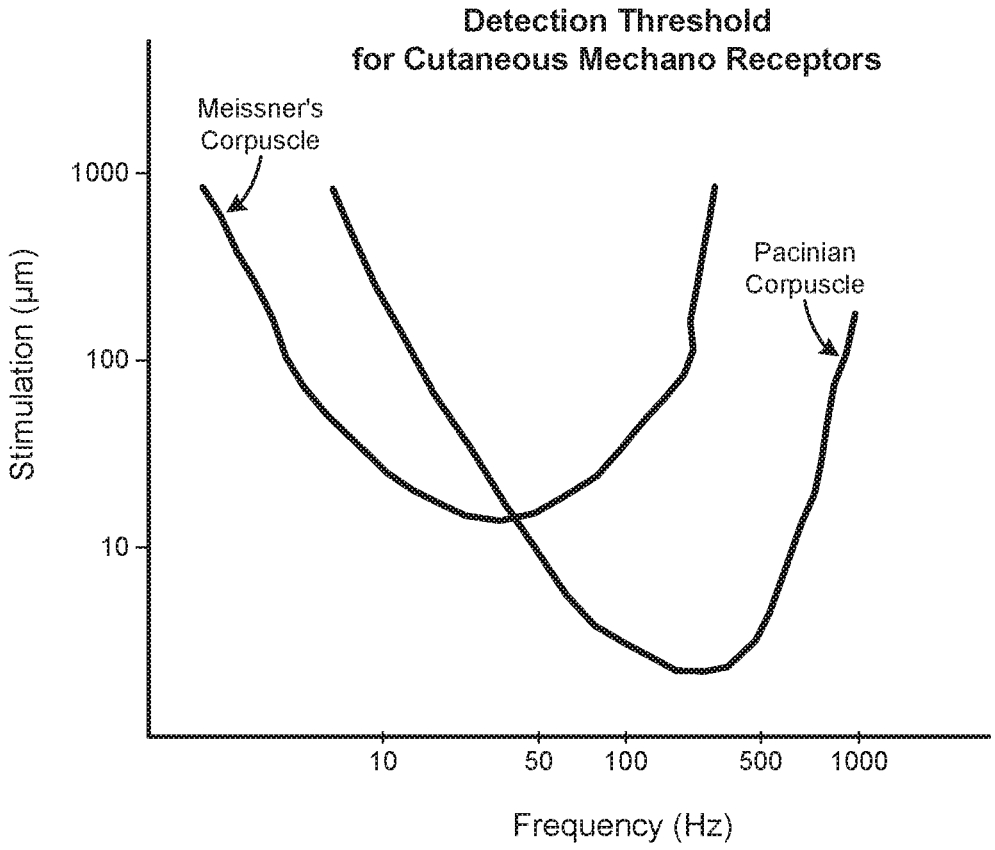
FIG. 8 depicts the sensory thresholds of cutaneous vibration receptors which the technology disclosed herein stimulates.

FIG. 8 depicts the sensory thresholds of cutaneous vibration receptors which the technology disclosed herein stimulates. The most sensitive frequencies are below 500 Hz. The vibrotactile speaker can be optimized to provide stimulation over this frequency range.

Figure 9:
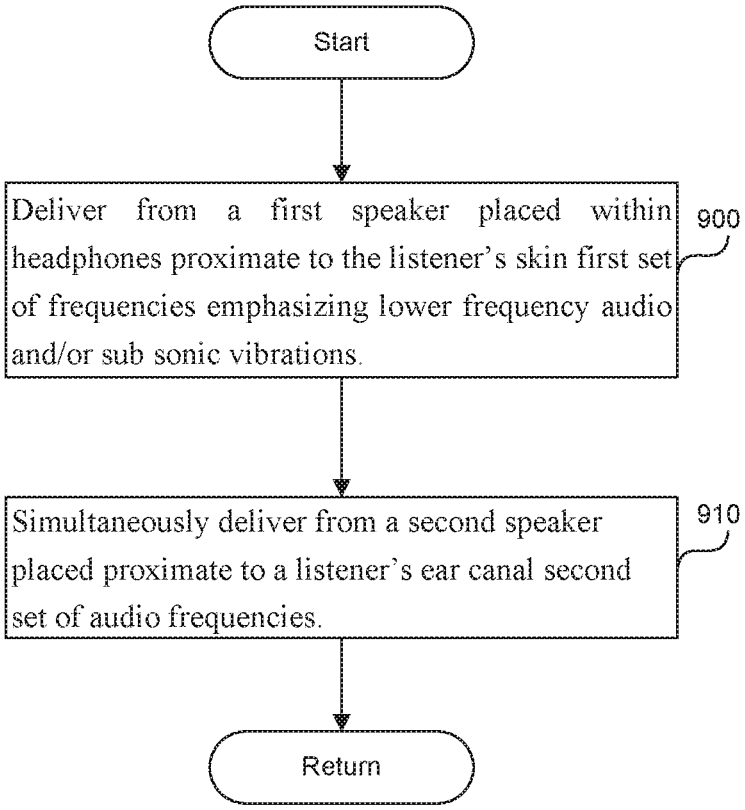
FIG. 9 is a flowchart of a method to isolate a listener from ambient sound and to deliver high-quality audio to the listener, according to one embodiment.

FIG. 9 is a flowchart of a method to isolate a listener from ambient sound and to deliver high-quality audio to the listener, according to one embodiment. In step 900, a first speaker disposed within headphones proximate to the listener's skin, delivers to listener a first range of frequencies. The delivered first range of frequencies induces a vibrotactile response in the listener's skin. The first range of frequencies can include a broad range of audio frequencies, usually emphasizing sub sonic vibrations, low-frequency audio and/or mid-frequency audio contained in an input audio signal. The first speaker can be disposed within an ear-cup associated with headphones, and/or a headband associated with the headphones.

In step 910, simultaneously with the delivery of the first range of frequencies from the first speaker, a second speaker disposed within an ear-bud associated with the headphones delivers a second range of frequencies to a listener's ear canal. The second range of frequencies can include the full range of audible frequencies, or a subset of audible frequencies such as frequencies substantially complementing the first range of frequencies.

The ear-cup and the ear-bud provide passive noise cancellation by blocking the passage of ambient sound to the listener, and from the listener to the environment. The ear-cup coupled to the headphones substantially surrounds a listener's ear thus blocking majority of ambient sound from reaching the listener, and blocking majority of listener's audio from leaking into the environment. The ear-cup can completely surround the listener's ear by pressing against the listener's skull, can partially press against the listener's skull and the listener's ear, or can solely press against the listener's ear. The ear-bud occludes the listener's ear canal, and further isolates the listener's ear canal from audio outside the listener's ear canal and isolates the environment surrounding the ear-bud from audio within the ear-bud. The position of the ear-bud disposed within the listener's ear canal can be automatically adjusted using elastic attachment to the ear-cup, such as a spring or elastic scaffolding. The automatic adjustment improves the seal of the listener's ear canal, thus improving passive noise cancellation.

The headphones can also provide active noise cancellation (ANC). A noise cancellation circuit associated with the headphones obtains from a plurality of microphones a plurality of undesired audio signals. The plurality of microphones include a first microphone disposed outside the headphones, a second microphone disposed within the ear-cup but outside the ear-bud, and a third microphone disposed within the ear-bud. The noise cancellation circuit can be digital or analog, and can include one or more noise cancellation circuits corresponding to the plurality of microphones, as described herein For each undesired audio signal in the plurality of undesired audio signals, the noise cancellation circuit generates a canceling signal such that the canceling signal destructively interferes with the undesired audio. The canceling signal can include a phase shift of the undesired audio or inverted polarity of the undesired audio, thus destructively interfering with the undesired audio signal. For each undesired audio signal in the plurality of undesired audio signals, the noise cancellation circuit delivers the canceling signal to one or more speakers. The one or more speakers comprise the first speaker and/or the second speaker.

An electronic component associated with the headphones separates an incoming audio signal into the first range of frequencies and the second range of frequencies. The electronic component can be a processor, and/or an analog circuit. In addition, the electronic component can generate subsonic and low frequencies to enhance the vibrotactile stimulation. First, the electronic component receives an audio signal. The electronic component then separates the audio signal into the first range of frequencies and a second range of frequencies by performing band-pass filtering. The first range of frequencies includes low-frequency audio and/or subsonic vibrations. The second range of frequencies includes high-frequency audio. Mid-frequency audio can be included in the first range of frequencies and/or the second range of frequencies. The electronic component sends the first range of frequencies to the first speaker, and the second range of frequencies to the second speaker. When the electronic component is a processor, the processor can be any type of processor, or microcontroller as described herein.

In addition, the frequency separation can be done entirely passively by the acoustic tuning of the speakers. In other words, the first speaker can be tuned to emit only low-frequency audio and/or subsonic vibrations, while the second speaker can be tuned to emit high-frequency audio. Mid-frequency audio can be emitted either by the first or the second speaker.

Computer

Figure 10:
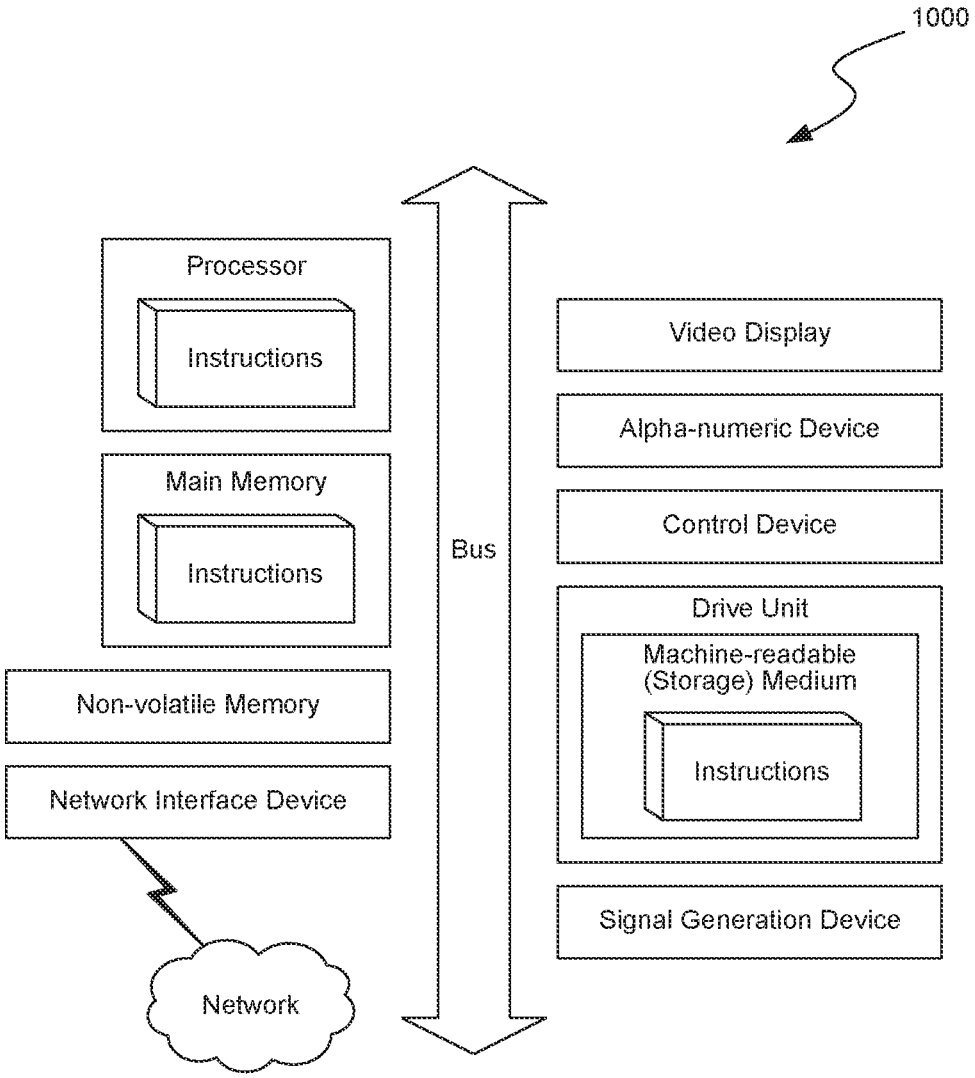
FIG. 10 is a diagrammatic representation of a machine in the example form of a computer system within which a set of instructions for causing the machine to perform any one or more of the methodologies or modules discussed herein may be executed.

FIG. 10 is a diagrammatic representation of a machine in the example form of a computer system 1000 within which a set of instructions for causing the machine to perform any one or more of the methodologies or modules discussed herein may be executed.

In the example of FIG. 10, the computer system 1000 includes a processor, memory, non-volatile memory and an interface device. The processor can be used to perform ANC, and to separate incoming frequencies into various frequency bands as described herein. The processor can be located within the headphones, such as inside the headphones band, and/or within the ear cups. Further, the processor can be located on a remote computer and receive incoming frequencies from the headphones through wired or wireless connection. Various common components (e.g., cache memory) are omitted for illustrative simplicity. The computer system 1000 is intended to illustrate a hardware device on which any of the components described in the example of FIGS. 1-9 (and any other components described in this specification) can be implemented. The computer system 1000 can be of any applicable known or convenient type. The components of the computer system 1000 can be coupled together via a bus or through some other known or convenient device.

This disclosure contemplates the computer system 1000 taking any suitable physical form. As example and not by way of limitation, computer system 1000 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server or a combination of two or more of these. Where appropriate, the computer system 1000 may include one or more computer systems 1000; be unitary or distributed; span multiple locations; span multiple machines; or reside in a cloud, which may include one or more cloud components in one or more networks. Where appropriate, one or more computer systems 1000 may perform without substantial spatial or temporal limitation one or more steps of one or more methods described or illustrated herein. As an example and not by way of limitation, one or more computer systems 1000 may perform in real time or in batch mode one or more steps of one or more methods described or illustrated herein. One or more computer systems 1000 may perform at different times or at different locations one or more steps of one or more methods described or illustrated herein, where appropriate.

The processor may be, for example, a conventional microprocessor such as an Intel Pentium microprocessor or Motorola power PC microprocessor. One of skill in the relevant art will recognize that the terms "machine-readable (storage) medium" or "computer-readable (storage) medium" include any type of device that is accessible by the processor.

The memory is coupled to the processor by, for example, a bus. The memory can include, by way of example but not limitation, random access memory (RAM), such as dynamic RAM (DRAM) and static RAM (SRAM). The memory can be local, remote, or distributed.

The bus also couples the processor to the non-volatile memory and drive unit. The non-volatile memory is often a magnetic floppy or hard disk, a magnetic-optical disk, an optical disk, a read-only memory (ROM), such as a CD-ROM, EPROM, FLASH, or EEPROM, a magnetic or optical card, or another form of storage for large amounts of data. Some of this data is often written, by a direct memory access process, into memory during execution of software in the computer 1000. The non-volatile storage can be local, remote, or distributed. The non-volatile memory is optional because systems can be created with all applicable data available in memory. A typical computer system will usually include at least a processor, memory, and a device (e.g., a bus) coupling the memory to the processor.

Software is typically stored in the non-volatile memory and/or the drive unit. Indeed, storing and entire large program in memory may not even be possible. Nevertheless, it should be understood that for software to run, if necessary, it is moved to a computer readable location appropriate for processing, and for illustrative purposes, that location is referred to as the memory in this paper. Even when software is moved to the memory for execution, the processor will typically make use of hardware registers to store values associated with the software, and local cache that, ideally, serves to speed up execution. As used herein, a software program is assumed to be stored at any known or convenient location (from non-volatile storage to hardware registers) when the software program is referred to as "implemented in a computer-readable medium." A processor is considered to be "configured to execute a program" when at least one value associated with the program is stored in a register readable by the processor.

The bus also couples the processor to the network interface device. The interface can include one or more of a modem or network interface. It will be appreciated that a modem or network interface can be considered to be part of the computer system 1000. The interface can include an analog modem, ISDN modem, cable modem, token ring interface, satellite transmission interface (e.g., "direct PC"), or other interfaces for coupling a computer system to other computer systems. The interface can include one or more input and/or output devices. The I/O devices can include, by way of example but not limitation, a keyboard, a mouse or other pointing device, disk drives, printers, a scanner, and other input and/or output devices, including a display device. The display device can include, by way of example but not limitation, a cathode ray tube (CRT), liquid crystal display (LCD), or some other applicable known or convenient display device. For simplicity, it is assumed that controllers of any devices not depicted in the example of FIG. 10 reside in the interface.

In operation, the computer system 1000 can be controlled by operating system software that includes a file management system, such as a disk operating system. One example of operating system software with associated file management system software is the family of operating systems known as Windows® from Microsoft Corporation of Redmond, Wash. and their associated file management systems. Another example of operating system software with its associated file management system software is the Linux™ operating system and its associated file management system. The file management system is typically stored in the non-volatile memory and/or drive unit and causes the processor to execute the various acts required by the operating system to input and output data and to store data in the memory, including storing files on the non-volatile memory and/or drive unit.

Some portions of the detailed description may be presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of operations leading to a desired result. The operations are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or "generating" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The algorithms and displays presented herein are not inherently related to any particular computer or other apparatus. Various general purpose systems may be used with programs in accordance with the teachings herein, or it may prove convenient to construct more specialized apparatus to perform the methods of some embodiments. The required structure for a variety of these systems will appear from the description below. In addition, the techniques are not described with reference to any particular programming language, and various embodiments may thus be implemented using a variety of programming languages.

In alternative embodiments, the machine operates as a standalone device or may be connected (e.g., networked) to other machines. In a networked deployment, the machine may operate in the capacity of a server or a client machine in a client-server network environment, or as a peer machine in a peer-to-peer (or distributed) network environment.

The machine may be a server computer, a client computer, a personal computer (PC), a tablet PC, a laptop computer, a set-top box (STB), a personal digital assistant (PDA), a cellular telephone, an iPhone, a Blackberry, a processor, a telephone, a web appliance, a network router, switch or bridge, or any machine capable of executing a set of instructions (sequential or otherwise) that specify actions to be taken by that machine.

While the machine-readable medium or machine-readable storage medium is shown in an exemplary embodiment to be a single medium, the term "machine-readable medium" and "machine-readable storage medium" should be taken to include a single medium or multiple media (e.g., a centralized or distributed database, and/or associated caches and servers) that store the one or more sets of instructions. The term "machine-readable medium" and "machine-readable storage medium" shall also be taken to include any medium that is capable of storing, encoding or carrying a set of instructions for execution by the machine and that cause the machine to perform any one or more of the methodologies or modules of the presently disclosed technique and innovation.

In general, the routines executed to implement the embodiments of the disclosure, may be implemented as part of an operating system or a specific application, component, program, object, module or sequence of instructions referred to as "computer programs." The computer programs typically comprise one or more instructions set at various times in various memory and storage devices in a computer, and that, when read and executed by one or more processing units or processors in a computer, cause the computer to perform operations to execute elements involving the various aspects of the disclosure.

Moreover, while embodiments have been described in the context of fully functioning computers and computer systems, those skilled in the art will appreciate that the various embodiments are capable of being distributed as a program product in a variety of forms, and that the disclosure applies equally regardless of the particular type of machine or computer-readable media used to actually effect the distribution.

Further examples of machine-readable storage media, machine-readable media, or computer-readable (storage) media include but are not limited to recordable type media such as volatile and non-volatile memory devices, floppy and other removable disks, hard disk drives, optical disks (e.g., Compact Disk Read-Only Memory (CD ROMS), Digital Versatile Disks, (DVDs), etc.), among others, and transmission type media such as digital and analog communication links.

In some circumstances, operation of a memory device, such as a change in state from a binary one to a binary zero or vice-versa, for example, may comprise a transformation, such as a physical transformation. With particular types of memory devices, such a physical transformation may comprise a physical transformation of an article to a different state or thing. For example, but without limitation, for some types of memory devices, a change in state may involve an accumulation and storage of charge or a release of stored charge. Likewise, in other memory devices, a change of state may comprise a physical change or transformation in magnetic orientation or a physical change or transformation in molecular structure, such as from crystalline to amorphous or vice versa. The foregoing is not intended to be an exhaustive list in which a change in state for a binary one to a binary zero or vice-versa in a memory device may comprise a transformation, such as a physical transformation. Rather, the foregoing is intended as illustrative examples.

A storage medium typically may be non-transitory or comprise a non-transitory device. In this context, a non-transitory storage medium may include a device that is tangible, meaning that the device has a concrete physical form, although the device may change its physical state. Thus, for example, non-transitory refers to a device remaining tangible despite this change in state.

Remarks

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling others skilled in the relevant art to understand the claimed subject matter, the various embodiments, and the various modifications that are suited to the particular uses contemplated.

While embodiments have been described in the context of fully functioning computers and computer systems, those skilled in the art will appreciate that the various embodiments are capable of being distributed as a program product in a variety of forms, and that the disclosure applies equally regardless of the particular type of machine or computer-readable media used to actually effect the distribution.

Although the above Detailed Description describes certain embodiments and the best mode contemplated, no matter how detailed the above appears in text, the embodiments can be practiced in many ways. Details of the systems and methods may vary considerably in their implementation details, while still being encompassed by the specification. As noted above, particular terminology used when describing certain features or aspects of various embodiments should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless those terms are explicitly defined herein. Accordingly, the actual scope of the invention encompasses not only the disclosed embodiments, but also all equivalent ways of practicing or implementing the embodiments under the claims.

The language used in the specification has been principally selected for readability and instructional purposes, and it may not have been selected to delineate or circumscribe the inventive subject matter. It is therefore intended that the scope of the invention be limited not by this Detailed Description, but rather by any claims that issue in an application based hereon. Accordingly, the disclosure of various embodiments is intended to be illustrative, but not limiting, of the scope of the embodiments, which is set forth in the following claims.

The invention claimed is:

1. A system to isolate a listener from ambient sound, and to deliver audio to the listener, the system comprising:

an ear-cup configured to be placed on or around a listener's ear and to attenuate the ambient sound reaching a listener's ear canal, the ear-cup comprising:

a first speaker to emit a first range of frequencies comprising audio frequencies producing vibrotactile stimulation of a listener's skin;

a first acoustic chamber to deliver the first range of frequencies to the listener through vibrotactile stimulation of the listener's skin, and further the first acoustic chamber configured to be disposed on or around the listener's ear;

an ear-bud configured to be placed within or at an entrance of the listener's ear canal and to attenuate the ambient sound and the first range of frequencies reaching the listener's ear canal, the ear-bud comprising:

a second speaker to emit a second range of frequencies, wherein the second range of frequencies comprises a mid and a high frequency portion of audible frequencies; and a second acoustic chamber to simultaneously deliver the second range of frequencies to the listener through acoustic stimulation of the listener's ear canal.

2. The system of claim 1, wherein the second range of frequencies complements the first range of frequencies, and wherein the second range of frequencies tends to be higher than the first range of frequencies.

3. The system of claim 1, comprising: a first microphone disposed within the first acoustic chamber, the first microphone to receive a first audio noise within the first acoustic chamber;

a noise cancellation circuit configured to:

receive the first audio noise from the first microphone;

generate a first canceling signal to cancel the first audio noise; and deliver the first canceling signal to a speaker, the speaker comprising at least one of the first speaker or the second speaker.

4. The system of claim 3, comprising: a second microphone disposed outside the system, the second microphone to receive the ambient sound;

the noise cancellation circuit configured to:

receive the ambient sound from the second microphone; generate an environment canceling signal to cancel the ambient sound; and deliver the environment canceling signal to the first speaker.

5. The system of claim 4, comprising: a third microphone disposed within the second acoustic chamber, the third microphone to receive a second audio noise within the second acoustic chamber;

the noise cancellation circuit configured to:

receive the second audio noise from the third microphone;

generate a second canceling signal to cancel the second audio noise;

and deliver the second canceling signal to the second speaker.

6. The system of claim 1, the ear-bud comprising an ear-bud tip to isolate the listener's ear canal from undesired effects of active noise cancellation, the undesired effects comprising high-frequency noise and increased pressure on a listener's eardrum.

7. The system of claim 1, comprising: a microphone inside the ear-bud, the microphone to detect a listener's voice and to enable voice communication.

8. A system comprising:

a first speaker to emit a first range of frequencies comprising audio frequencies producing vibrotactile stimulation of a listener's skin;

a first acoustic chamber configured to be proximate to the listener's skin, the first acoustic chamber to deliver the first range of frequencies to a listener;

a second speaker to emit a second range of frequencies comprising a mid and a high frequency portion of audible frequencies; and a second acoustic chamber configured to be placed within or at an entrance of a listener's ear canal and to simultaneously deliver the second range of frequencies to the listener through acoustic stimulation of a listener's ear.

9. The system of claim 8, the first acoustic chamber to stimulate the listener through vibrotactile stimulation of the listener's skin.

10. The system of claim 8, wherein the first range of frequencies comprises sub-sonic vibrations.

11. The system of claim 8, wherein the first acoustic chamber is disposed within an ear-cup.

12. The system of claim 8, wherein the first acoustic chamber is disposed within a headband.

13. The system of claim 8, wherein the second acoustic chamber is disposed within an ear-bud.

14. The system of claim 8, comprising:

an ear-cup to attenuate ambient sound reaching the listener's ear; and an ear-bud surrounding the second acoustic chamber, the ear-bud placed at the entrance of the listener's ear canal or inserted within the listener's ear canal, the ear-bud to attenuate the ambient sound and the first range of frequencies reaching the listener's ear canal.

15. The system of claim 14, comprising: a microphone inside the ear-bud, the microphone to detect the listener's voice enabling voice communication.

16. The system of claim 14, comprising: a flexible attachment between the ear-bud and the ear-cup, the flexible attachment to automatically adjust a position of the ear-bud proximate the listener's ear canal.

17. The system of claim 8, comprising: an ear-cup to attenuate audio within the ear-cup from escaping into environment surrounding the system; and an ear-bud surrounding the second acoustic chamber, the ear-bud placed at the entrance of the listener's ear canal or inserted within the listener's ear canal, the ear-bud to attenuate audio within the ear-bud escaping into environment surrounding the ear-bud.

18. The system of claim 8, the first speaker comprising at least one of a contact mode speaker, a loud low-frequency acoustic speaker, or a device to electrically stimulate cutaneous receptors.

19. The system of claim 8, comprising:

at least one microphone to receive at least one undesired audio signal;

a noise cancellation circuit configured to:

for each undesired audio signal, generate a canceling signal such that the canceling signal destructively interferes with the undesired audio signal; and for each undesired audio signal, deliver the canceling signal to one or more speakers, wherein the one or more speakers comprise the first speaker or the second speaker.

20. The system of claim 19, comprising a first microphone disposed outside the system, a second microphone disposed within an ear-cup, and a third microphone disposed within an ear-bud.

21. The system of claim 8, comprising an ear-bud surrounding the second acoustic chamber, the ear-bud comprising an ear-bud tip to isolate the listener's ear canal from undesired effects of active noise cancellation, the undesired effects comprising high-frequency noise and increased pressure on a listener's eardrum.

22. The system of claim 8, comprising an ear-bud surrounding the second acoustic chamber, the ear-bud comprising an ear-bud tip to isolate the listener's ear canal from ambient noise, the ear-bud tip comprising a soft material to adjust a shape of the ear-bud tip to a shape of the listener's ear canal, the soft material comprising a fluid.

23. The system of claim 22, the fluid comprising air, water, or a viscous fluid.

24. A method to isolate a listener from ambient sound, and to deliver audio to the listener, the method comprising:

delivering from a first speaker disposed within a headphone configured to be proximate to a listener's skin, a first range of frequencies comprising audio frequencies capable of inducing vibrotactile stimulation of the listener's skin; and simultaneously with said delivering from the first speaker, delivering from a second speaker disposed within an ear-bud placed within the headphone a second range of frequencies to a listener's ear canal, the second range of frequencies comprising a mid and a high frequency portion of audible frequencies.

25. The method of claim 24, said delivering from the first speaker comprising:

delivering from the first speaker disposed within an ear-cup associated with the headphone low audio frequencies and subsonic vibrations to the listener's skin.

26. The method of claim 24, said delivering from the first speaker comprising:

delivering from the first speaker disposed within a headband associated with the headphone low audio frequencies and subsonic vibrations to the listener's skin.

27. The method of claim 24, said delivering from the second speaker comprising:

simultaneously with said delivering from the first speaker, delivering from the second speaker disposed within the ear-bud associated with the headphone high-frequency audio to the listener's ear canal.

28. The method of claim 24, comprising:

surrounding a listener's ear with an ear-cup coupled to the headphone, said surrounding the listener's ear comprising isolating the listener's ear from the ambient sound, and isolating environment surrounding the headphone from audio within the ear-cup; and blocking the listener's ear canal with the ear-bud, said blocking comprising isolating the listener's ear canal from audio outside the listener's ear canal and isolating environment surrounding the ear-bud from audio within the ear-bud.

29. The method of claim 24, comprising:

obtaining from a plurality of microphones a plurality of undesired audio signals, wherein the plurality of microphones comprise a first microphone disposed outside the headphone, a second microphone disposed within an ear-cup, and a third microphone disposed within the ear-bud;

for each undesired audio signal in the plurality of undesired audio signals, generating, by a noise cancellation circuit, a canceling signal such that the canceling signal destructively interferes with the undesired audio signal; and for each undesired audio signal in the plurality of undesired audio signals, delivering the canceling signal to one or more speakers, wherein the one or more speakers comprise the first speaker or the second speaker.

30. The method of claim 24, comprising automatically adjusting a position of the ear-bud disposed within the listener's ear canal.

* * * * *